US006681086B2

(12) United States Patent
Sahara

(10) Patent No.: US 6,681,086 B2
(45) Date of Patent: Jan. 20, 2004

(54) SEALING MEMBER FOR PREVENTING ESCAPE OF MICRO PARTICLES

(75) Inventor: Yoshinori Sahara, Osaka (JP)

(73) Assignee: Toyo Boseki Kabushiki Kaisha, Osaka (JP)

( * ) Notice: Subject to any disclaimer, the term of this patent is extended or adjusted under 35 U.S.C. 154(b) by 0 days.

(21) Appl. No.: 10/287,145

(22) Filed: Nov. 4, 2002

(65) Prior Publication Data

US 2003/0091365 A1 May 15, 2003

(30) Foreign Application Priority Data

Nov. 7, 2001 (JP) ..... 2001-342333

(51) Int. Cl.[7] ..... G03G 15/08; G03G 21/00
(52) U.S. Cl. ..... 399/102; 399/103
(58) Field of Search ..... 399/102–104, 399/106

(56) References Cited

U.S. PATENT DOCUMENTS

| | | | | |
|---|---|---|---|---|
| 5,029,316 A | * | 7/1991 | Koiso | 399/102 |
| 5,216,467 A | | 6/1993 | Esser et al. | |
| 6,115,566 A | | 9/2000 | Ohara et al. | 399/103 |
| 6,253,043 B1 | * | 6/2001 | Isobe | 399/103 |

FOREIGN PATENT DOCUMENTS

| | | |
|---|---|---|
| DE | 198 54 397 A1 | 5/2000 |
| EP | 0 407 810 A2 | 1/1991 |
| JP | 05-210290 | 8/1993 |
| JP | 11-061101 A | 3/1999 |

OTHER PUBLICATIONS

European Search Report.

* cited by examiner

*Primary Examiner*—William J. Royer
(74) *Attorney, Agent, or Firm*—Leydig, Voit & Mayer, Ltd.

(57) ABSTRACT

A sealing member for preventing escape of micro particles, sealing a predetermined gap between a movable unit in contact with the micro particles and a housing of the movable unit, and adhered to the face of the movable unit or housing without impeding movement of the movable unit, based on a pile fabric configured with a pile yarn forming a sliding flock and a base cloth of plain woven tissue supporting the pile yarn, the pile yarn of the flock being formed of a high strength polyethylene fiber having a filament fineness of 0.1–6.0 dTex, a fiber cross section oblateness of at least 1.1, and an average tensile strength of at least 22 cN/dTex, and the flock having a height of 1.5–4.0 mm, a pile density of 13,000–346,000 filament/cm$^2$ at the pile yarn portion, and a pile yarn cross section area of 0.02–0.2 cm$^2$per 1 cm$^2$ of the base cloth. The sealing member includes a coating layer at the back side of the base cloth to prevent fall off of the flock, and is superior in sidability and abrasion resistance.

3 Claims, 1 Drawing Sheet

SEALING MEMBER FOR PREVENTING ESCAPE OF MICRO PARTICLES

BACKGROUND OF THE INVENTION

1. Field of the Invention

The present invention relates to a sealing member for preventing escape of micro particles. More particularly, the present invention relates to a sealing member for preventing scattering of toner micro particles out from the gap between a magnet roller and housing of an electrophotographic copy machine that employs toner micro particles to obtain, for example, a vivid picture.

2. Description of the Background Art

Conventionally, a developing chamber (also called "developing device") of an electrophotographic copy machine or a printer of office machinery is appropriately covered with a housing. Toner particles are applied onto a photoreceptor from a magnet roller charged with toner particles in the developing chamber to form a toner image. Then, a sheet is placed on the photoreceptor on which an image is formed, whereby the toner at the surface of the photoreceptor is transferred onto the sheet. At the housing region corresponding to the ends of the magnet roller at the bearing side, a sealing member is attached to seal the gap between the two ends of the magnet roller and the housing to prevent toner particles from escaping.

The conventional sealing member employs a layered structure of a wool and/or synthetic fiber felt or sponge adhered to a felt layer of fluorocarbon fiber (structure a), a velvet layer of fluorocarbon fiber (structure b), or a layered structure of a sponge layer adhered to a velvet layer of fluorocarbon fiber (structure c).

The aforementioned layered sealing member of "structure a" exhibits ravel and fall off as well as poor restoration of the fiber since the sliding region of the sealing member is formed of a felt layer. There was a problem that, when used over a long period of time, the sealing ability is degraded to result in escape of the toner particles. Furthermore, when attached to the curve face of the housing, the sliding region of the sealing member will be crimpled to form a gap through which toner particles will escape.

The aforementioned velvet layer sealing member of "structure b" must have a flock length of at least 5 mm to seal the gap between the housing and the magnet roller. There was a problem that the cost is increased when fluorocarbon fiber is used.

The aforementioned layered sealing member of "structure c", when used for a developing chamber with toner of micro particles not more than 10$\mu$, could not prevent such toner particles from escaping through the gap. It is to be noted that the toner micro particles used in electrophotographic copy machines and printers of office machinery directed to obtain a vivid picture are now as small as 10$\mu$ and below, for example, in particle size.

SUMMARY OF THE INVENTION

The present invention is directed to solve the above-described problems in conventional sealing members. An object of the present invention is to provide a sealing member exhibiting favorable retention and without the fall off of the flock of fiber brought into contact with a movable unit such as a magnet roller in contact with micro particles such as fine toner in a housing, and that has sufficient sealing ability to prevent escape of micro particles smaller than 10$\mu$, for example, in particle size, without degrading the function of the movable unit.

The structure of the present invention is set forth below.

The sealing member of the present invention seals a predetermined gap between a movable unit that is brought into contact with micro particles and a housing of the movable unit, adhered to a face of the movable unit or housing to prevent escape of the micro particles without impeding the movement of the movable unit. The sealing member is based on a pile fabric configured with a pile yarn that forms a sliding flock and a base cloth of plain woven tissue supporting the pile yarn. The pile yarn of the flock is a high strength polyethylene fiber having a filament fineness of 0.1–6.0 dTex, a fiber cross section oblateness of at least 1.1, and an average tensile strength of at least 22 cN/dTex. The flock height is 1.5–4.0 mm. The pile density of the pile yarn region is 13,000–346,000 filament/cm$^2$. The pile yarn cross section area per 1 cm$^2$ of the base cloth, obtained from the following equation (1), is 0.02–0.2 cm$^2$. The sealing member includes a coating layer at the back side of the base cloth to prevent the fall off of the flock.

$$S=f\times d\div\rho\div 1{,}000{,}000 \quad (1)$$

S: a pile yarn cross section area (cm$^2$)

f: filament fineness of pile yarn (dTex)

d: pile density of flock (filament/cm$^2$)

ρ: specific gravity of pile yarn (g/cm$^3$)

According to the present invention, the sealing member is attached at the gap between the movable unit and the housing. The plain woven tissue and coating layer are flexible, and can easily be attached corresponding to the attaching configuration of the movable unit or housing. The pile yarn of the flock is supported by the plain woven tissue. The pile yarn is prevented from falling off by means of the coating layer. The gap between the movable unit and the housing is blocked by a pile yarn of 1.5–4.0 mm. The pile yarn with 0.1–6.0 dTex as the filament fineness, 13,000–346,000 filament/cm$^2$ as the pile density at the pile yarn portion, and 0.02–0.2 cm$^2$ as pile yarn cross section area per 1cm$^2$ of the base cloth obtained from equation (1) can function to prevent escape of micro particles. The pile yarn is composed of a high strength polyethylene fiber having an average tensile strength of at least 22 cN/dTex. The pile yarn has a low abrasive coefficient and is resistant to abrasion, suitable to usage over a long period of time. Therefore, the sealing member of the present invention is superior in sidability and abrasion resistance.

According to another aspect of the present invention, the above sealing member has a cushion layer adhered to the bottom plane of the coating layer. The cushion layer is of 3–30 times foam and has a 25% compressive load value of 0.1–0.6 kg/cm$^2$.

In the invention of the present aspect, attachment to the curved surface is further facilitated by the flexible cushion layer. In other words, the sealing member can be attached to the curved housing face without the plain woven tissue and coating layer being crimpled.

In the present invention, it is desirable that the pile yarns are brushed to be laid down in a predetermined direction.

In the present invention, a secure sealing layer is achieved since the group of pile yarns laid down in one direction captures micro particles within the group of pile yarns. The trapping of micro particles is facilitated by the lay down of the pile yarn to prevent micro particles from escaping. Since uneven lay down of the flock and the natural wave are eliminated by the brushing process, splitness is increased to result in stable sealing ability. Therefore, micro particles will not escape. The sealing ability is particularly favorable with respect to micro particles of 10$\mu$ and below.

As to the values of the filament fineness of the pile yarn that forms the flock, the flock height, and the flock pile density, the ranges set forth below were obtained as a result of testing the range in which toner of micro particles do not escape. In practice, the filament fineness of the pile yarn that forms the flock is preferably 0.1–6 dTex, and the fiber cross section oblateness is preferably at least 1.1. The height of flock is preferably in the range of 1.5–4.0 mm. A flock shorter than 1.5 mm offers difficulty in fabrication. Although the sealing property will not be degraded even if the flock is longer than 4.0 mm, the cost will be increased in such a case. The pile density of the flock is preferably in the range of 13,000–346,000 filament/cm$^2$. The pile yarn cross section area per 1 cm$^2$ of the base cloth, obtained from equation (1), is preferably in the range, of 0.02–0.2 cm$^2$. If the pile density and the pile yarn cross section area are lower than 13,000 filament/cm$^2$ and 0.02 cm$^2$, respectively, micro particles will escape. If the pile density and the pile yarn cross section area are greater than 346,000 filament/cm$^2$ and 0.2 cm$^2$, respectively, the cost will be increased. Thus, the flock of the present invention is selected to be within the above practical ranges taking economical efficiency into account.

Polyurethane foam is employed for the cushion layer. This cushion layer must be flexible enough to be favorably adhered to the housing face. Based on tests, a cushion layer having the physical properties of 3–30 times foam, and a 25% compressive load value of 0.1–0.6 kg/cm$^2$ was appropriate for the present invention. If the 25% compressive load value is lower than 0.1 kg/cm$^2$, the cushion layer will be too soft. If the 25% compressive load value is higher than 0.6 kg/cm$^2$, the cushion layer will be so hard that it cannot be easily bent. The cushion layer will not easily follow the curved housing face, resulting in degradation of the sealing property of the sealing member. The material of the cushion layer is not limited to polyurethane, and may include rubber, elastomer, and the like.

The lay down of the flock is effected by brushing down the flocks in a predetermined direction. By this brushing process, uneven lay down and waves in the yarn will be eliminated.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
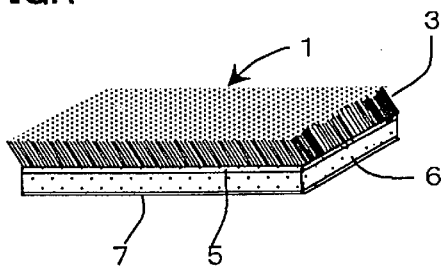
FIG. 1 is a schematic perspective view of a sealing member according to an embodiment of the present invention.
Figure 2:
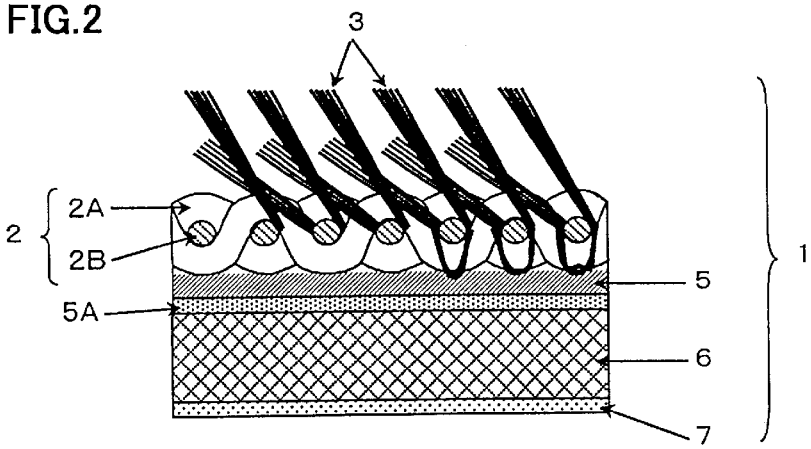
FIG. 2 is an enlarged sectional view of the structure of the sealing member of the present invention.

The sealing member of the present embodiment is applied to a magnet roller in a developing chamber of an electrophotographic copy machine that employs toner micro particles having a particle size of not more than 10$\mu$ in order to obtain an image of high resolution. FIG. 1 shows a perspective view of a sealing member 1. FIG. 2 shows an enlarged cross sectional view of sealing member 1.

Sealing member 1 is formed of a bonded structure of a base cloth 2 having a flock 3, a coating layer 5 at the back side of base cloth 2, and a flexible and resilient cushion layer 6. At the bottom of cushion layer 6 is provided an adhesive layer 7 to affix the above structure to the application region. Referring to FIG. 2, base cloth 2 of plain woven tissue is formed of a weft 2A and a warp 2B, and has a high strength polyethylene fiber formed at one side in a pile-woven manner as a pile yarn flock 3. The high strength polyethylene fiber has a filament fineness of 0.1–6 dTex, a fiber cross section oblateness of at least 1.1, and an average tensile strength of at least 22 cN/dTex. Flock 3 functions as the member sliding in contact with the magnet roller.

Figure 3A:
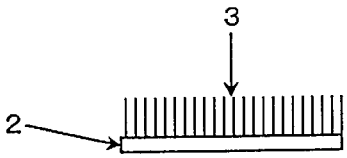
FIG. 3A is a schematic cross sectional view of the pile fabric, representing a state where the flock is not yet laid down.

As shown in FIGS. 1 and 2, flock 3 is obliquely laid down in a predetermined direction with respect to base cloth 2. The lay down of flock 3 can be easily conducted by brushing down the pile fabric, i.e. base cloth 2 with upright flock 3 shown in FIG. 3A.

Figure 3B:
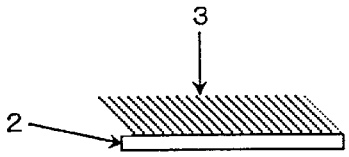
FIG. 3B is a schematic cross sectional view of the pile fabric, representing a state where the flock is laid down.

Base cloth 2 with flock 3 laid down as shown in FIG. 3B can be obtained by passing through base cloth 2 with flock 3 between a trench roller that has many trenches of 1–3 mm in depth and a foot roller. The flock side of base cloth 2 faces the trench roller during the brushing passage. It is to be noted that the brushing process to lay down flock 3 is not limited to the type described above.

It is desirable that weft 2A and warp 2B of base cloth 2 is made of a material having heat resistance to the temperature of the copy machine, i.e. resistance to the temperature of 60° C., for example, for over a long period of time, and that can be adhered by an adhesive. The preferable material includes cotton, polyester, polypropylene, acrylic, nylon, urethane, and the like. In the present embodiment, base cloth 2 includes a warp 2B of polyester and a weft 2A of polyester.

A high strength polyethylene fiber of 22 cN/dTex and above in average tensile strength has a low abrasive coefficient. Therefore, such a high strength polyethylene fiber is a preferable material for flock 3. Such high strength polyethylene fibers of at least 22 cN/dTex in average tensile strength includes, for example, fluorocarbon resin fiber, polytetrafluoroethylene (PTFE), tetrafluoroethylene-hexafluoropropylene copolymer (FEP), tetrafluoroethylene-per-fluoroalkyl vinyl ether copolymer (PFA), tetrafluoroethylene copolymer (ETFE), and the like.

A fiber having a low abrasive coefficient, appropriate abrasion resistance and heat resistance can be employed for the flock 3. Since the fiber functioning as flock 3 must be flexible, it is desirable that, when a high strength polyethylene fiber having an average tensile strength of at least 22 cN/dTex is to be used, the filament fineness is 0.1–6.0 dTex, and the fiber cross section oblateness is at least 1.1. The base cloth 2 of the present embodiment was woven with a pile loom under the conditions shown in the following Table 1, using high strength polyethylene (product name "Dyneema" from TOYO BOSEKI KABUSHIKI KAISHA) of 165 dTex/140 filament for flock 3, polyester of 230 dTex/48 filament for warp 2B, and a polyester spun yarn of thread size 20/2 for weft 2A of base cloth 2.

TABLE 1

| | |
|---|---|
| Used reed | 40 (dent/in) |
| Embedding number | 68 (filament/in) |
| Weave density | 29,500 (filament/cm$^2$) |
| Pile height | 2.5 (mm) |

Base cloth 2 with flock 3 laid down has coating layer 5 formed at the back side. For coating layer 5, water type emulsion resin, rubber type solvent adhesive, hot melt type adhesive, adhesive resin, or the like, that is pliable (flexible) when cured, can be employed. The above-described adhesive is permeated between the fibers of base cloth 2 to hold flock 3 securely. The back side of base cloth 2 may be subjected to latex coating such as styrene-butadiene rubber (SBR), ethylene-vinyl acetate (EVA), polymethyl methacrylate (PMMA), and the like. When latex coating is used for coating layer 5, coating layer 5 is bonded with cushion layer 6 by an adhesive layer 5A as in sealing member 1 shown in FIG. 2. For adhesive layer 5A, the general adhesive, for example, rubber type adhesive, acrylic type adhesive, or pressure sensitive adhesive can be used.

Cushion layer 6 is bonded at the bottom of coating layer 5. Cushion layer 6 must be formed of a material that has durability to wear, heat resistance to a high temperature of 60° C., for example, over a long period of time, and that can be adhered with an adhesive. Therefore, the material of cushion layer 6 is desirably a resin such as polyurethane, styrol or polypropylene, synthetic rubber such as EPDM (ethylene propylene rubber) or chloroprene, natural rubber, or thermoplastic elastomer such as of the olefin type and styrene type, or the like. Also, it is desirable that the material of cushion layer 6 has sufficient adhesion to a movable unit, and is of approximately 3–30 times foam to obtain the flexibility and resilience so as to not impede the rotation. Based on tests, the rebound physical property of cushion layer 6 is preferably approximately 0.1–0.6 kg/cm$^2$ based on 25% compressive load.

Polyurethane foam of 2 mm in thickness and 0.5 kg/cm$^2$ based on 25% compressive load is used for cushion layer 6 in the present embodiment. Cushion layer 6 is bonded to the back side of base cloth 2 by overlapping cushion layer 6 on the applied uncured coating layer 5 during formation of coating layer 5 at the back side of base cloth 2. In the case where cushion layer 6 is to be bonded after formation of coating layer 5 at the back side of base cloth 2, the above mentioned type of adhesive used in forming coating layer 5 can be employed as the adhesive.

Although adhesive layer 7 to affix cushion layer 6 at an appropriate region employs the aforementioned pressure sensitive adhesive of the rubber type and acrylic type, a general adhesive can also be employed. In the present embodiment, coating layer 5 and adhesive layer 7 for attachment employ an acrylic type pressure sensitive adhesive.

As a result of tests, the abrasive coefficient (coefficient of dynamic friction) of sealing member 1 of the present embodiment was as shown in Table 2. The test was carried out at the sliding velocity of 1000 mm/min. The control (conventional) sealing member A in Table 2 corresponds to a structure (the above-described conventional layered structure of "structure a"; not shown) of a wool felt cushion layer of 1.5 mm in thickness adhered using an acrylic type adhesive to a 1.0 mm-thick felt sliding region formed of polytetrafluoroethylene. The control sealing member B was produced using a high-molecular-weight polyethylene fiber having a filament fineness of 6.6 dTex and a fiber cross section oblateness of below 1.1 for the pile yarn with a flock of 4,900 filament/cm$^2$ in pile density, and subjected to a process similar to that of sealing member 1 of the present embodiment.

TABLE 2

| Testing Sample | Load 1.0 kg/cm$^2$ | Load 3.5 kg/cm$^2$ | Sealing Ability |
|---|---|---|---|
| Sealing member 1 of Present Embodiment | 0.11 | 0.10 | ◎ |
| Control sealing member A (conventional) | 0.15 | 0.13 | Δ |
| Control sealing member B | 0.11 | 0.10 | ○ |

It was appreciated from the results of Table 2 that sealing member 1 of the present embodiment and control sealing member B exhibit an abrasive coefficient lower than that of control sealing member A, i.e. the conventional case. The pile fabric of the present embodiment employing a super high strength polyethylene fiber and control sealing member B exhibited a lower abrasive coefficient since each fiber is arranged in the direction of rotation, as compared to the conventional felt. Also, since the abrasive coefficient becomes lower as the load becomes higher, the adhesion towards the magnet roller to improve the sealing ability can be increased.

It was recognized that sealing member 1 of the present embodiment has more favorable toner sealing ability than control sealing member B.

When a fiber having a fiber cross section oblateness of at least 1.1 is used as the pile yarn, the fiber surface area becomes larger than that of a fiber having a fiber cross section oblateness below 1.1 based on the same fineness. Therefore, the sealing ability can be improved by virtue of a larger area in contact with the toner.

The photoreceptor and copy sheets are disposed in the proximity of the developing chamber. Sealing member 1 of the present embodiment is used for the sealing of the magnet roller in the developing chamber of an electrophotographic copy machine. In the housing of the developing chamber, the magnet roller is arranged in a horizontal manner, and has the ends of the spindle supported rotatably at the bearing of the housing of the developing chamber. During the copy mode, the magnet roller is rotated with charged toner particles adhering to the magnet roller surface so that the micro particles are attached onto the photoreceptor. The micro particles of the toner image on the photoreceptor are transferred onto a copy sheet.

The housing portion corresponding to the two ends of the magnet roller has a circular recess (recessed surface) of a diameter larger than the diameter of the magnet roller. Sealing member 1 is attached at the inner side of the circular recess with flock 3 in a direction to form contact with toner micro particles (the rotating direction of the magnet roller) so as to block the gap between the outer circumference of the end of the magnet roller and the circumferential plane of the circular recess. Sealing member 1 is attached by adhering adhesive layer 7 to the circumferential plane of the circular recess. By using cushion layer 6 that is flexible and resilient, cushion layer 6 can be easily adhered, corresponding to the curved surface of the circular recess. By employing a double-faced tape with a core of acrylic foam, polyurethane foam, synthetic rubber, and elastomer, or a double-faced tape without a core for adhesive layer 7, generation of a crimple in sealing member 1 can be suppressed to conduct rotation of the magnet roller smoothly.

According to the present invention, an electrophotographic copy operation can be conducted using the magnet roller in the developing chamber in a manner similar to the conventional case. The gap is sealed to prevent toner micro particles from escaping out of the housing without impeding the rotation of the magnet roller by virtue of sealing member 1 with cushion layer 6 adhering to the circumferential plane of the circular recess, and resilient flock 3 forming the sliding portion in contact with the ends of the magnet roller.

Since flock 3 of sealing member 1 attached at the gap between the housing and the magnet roller is laid down in the rotating direction of the magnet roller, the micro particles of toner transferred towards sealing member 1 in association with the rotation of the magnet roller are trapped by flocks 3. Thus, the escape of toner micro particles through the gap can be prevented. A secure seal layer is established by flocks 3 and the toner particles trapped in flocks 3. Appropriate sealing ability of toner particles is achieved by rejecting the toner micro particles which are subsequently transferred towards sealing member 1.

Figure 4:
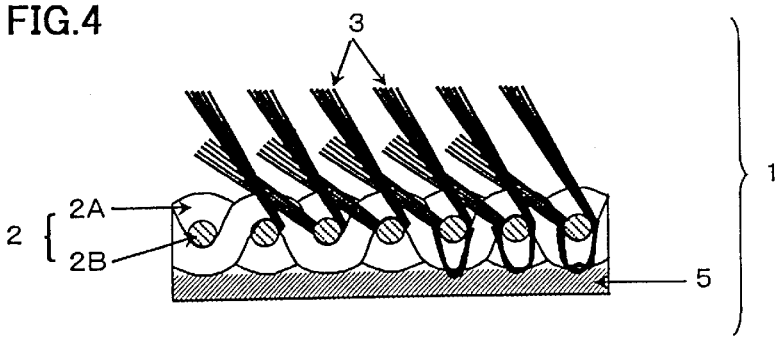
FIG. 4 is a schematic cross sectional view of a sealing member according to another embodiment of the present invention.

The above-described sealing member 1 of the present embodiment has a structure in which a cushion layer 6 and an adhesive layer 7 are attached at the bottom of coating layer 5 of base cloth 2, as shown in FIGS. 1 and 2. According to another embodiment of the present invention, sealing member 1 has a structure in which a soft coating layer 5 is provided at the bottom of base cloth 2, absent of cushion layer 6 and adhesive layer 7, as shown in FIG. 4. Sealing member 1 of this structure can prevent escape of toner micro particles depending upon the region of application. Sealing member 1 of the structure shown in FIG. 4 has a simple structure, and can be easily fabricated.

Although the sealing member of the present embodiment is applied to a magnet roller of an electrophotographic copy machine or the printer of office machinery to prevent the scattering of toner micro particles out from the gap between the magnet roller and housing, the sealing member of the present invention is not limited to the usage for a magnet roller. For example, the sealing member can be applied to a particle feeding roller of the cleaning unit of an electrophotographic copy machine or office printer, a wrapping machine that wraps up drugs of micro particles (powder or granule), and the like to prevent the scatter of the particles from the gap between the feeding roller and the housing. The sealing member of the present invention can be widely used as a sealing member to prevent escape of micro particles.

In the present invention, a pile yarn that is pile-woven fiber is employed as the flock, and a soft coating layer is adhered to the back side of the pile-woven base cloth. Therefore, the flock that forms contact with a movable unit is favorable in retention, and will not fall off. The gap can be sealed by the arrangement of the flock of pile-woven yarn of the sealing member at the gap between a movable unit and a housing, and by the attachment of the adhesive layer to the housing or the movable unit. Therefore, the sealing of the micro particles such as fine toners in the housing can be established sufficiently. In other words, micro particles are trapped in the flocks to prevent escape of micro particles. The flock of the sealing member is preferable as the sliding flock since it is formed of a fiber of low abrasive coefficient and has abrasion resistance. Furthermore, since the flock is appropriately flexible, the motion of the moving member will not be impeded. The filament fineness, the height, and the pile density of the flock pile yarn are selected so as to facilitate trapping of micro particles. Therefore, escape of micro particles as small as $10\mu$ or below, for example, can be prevented.

By providing a flexible cushion layer in the present invention, the sealing member can be adhered to the curved surface without being crimpled.

Since the sealing member of the present invention is used in a manner so that micro particles are brought into contact in the lay down direction of the flock, micro particles will be trapped in the flocks to prevent escape of the micro particles.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sealing member for preventing escape of micro particles, sealing a predetermined gap between a movable unit in contact with said micro particles and a housing of said movable unit, and adhered to a face of said movable unit or housing without impeding movement of said movable unit, based on a pile fabric configured with a pile yarn forming a sliding flock and a base cloth of plain woven tissue supporting said pile yarn, said pile yarn of the flock being formed of a high strength polyethylene fiber having a filament fineness of 0.1–6.0 dTex, a fiber cross section oblateness of at least 1.1, and an average tensile strength of at least 22 cN/dTex, and said flock having a height of 1.5–4.0 mm, a pile density of 13,000–346,000 filament/cm$^2$ at the pile yarn portion, and a pile yarn cross section area of 0.02–0.2 cm$^2$ per 1 cm$^2$ of the base cloth, obtained from an equation (1) of:

$$S = f \times d \div \rho \div 1{,}000{,}000 \quad (1)$$

where

S: a pile yarn cross section area (cm$^2$)

f: filament fineness of pile yarn (dTex)

d: pile density of flock (filament/cm$^2$)

ρ: specific gravity of pile yarn (g/cm$^3$); and said sealing member including a coating layer at a back side of said base cloth to prevent fall off of said flock.

2. The sealing member for preventing escape of micro particles according to claim 1, wherein a cushion layer of 3–30 times foam and having a 25% compressive load value of 0.1–0.6 kg/cm$^2$ is adhered to a bottom of said coating layer.

3. The sealing member for preventing escape of micro particles according to claim 1, wherein pile yarns are brushed to be laid down in a predetermined direction.

* * * * *

UNITED STATES PATENT AND TRADEMARK OFFICE

CERTIFICATE OF CORRECTION

PATENT NO. : 6,681,086 B2
DATED : January 20, 2004
INVENTOR(S) : Sahara

It is certified that error appears in the above-identified patent and that said Letters Patent is hereby corrected as shown below:

Title page,
Item [57], ABSTRACT,
Line 17, "sidability" should read -- slidability --.

Column 8,
Line 29, "adhered" should read -- adhering --.
Line 31, "unit, based on a pile fabric configured" should read -- unit, wherein said sealing member comprises:
(a) a pile fabric configured --.
Line 37, "and" should be deleted.
Line 50, "; and" should read -- , --.
Lines 51-52, "said sealing member including a coating layer at a back side of said base cloth to prevent fall off of said flock." should read -- said base cloth having a front side and an opposing back side, with said flock extending from said front side of said base cloth, and
(b) a coating layer having a top side and an opposing bottom side, with said coating layer disposed such that said top side of said coating layer is disposed at said back side of said base cloth to prevent fall off of said flock. --.
Lines 53-54, "member for preventing escape of micro particles according to claim 1, wherein a" should read -- member of claim 1, wherein said sealing member further comprises a --.
Line 56, "kg/cm$^2$ is adhered to a bottom of" should read -- kg/cm$^2$ adhered to said bottom side of --.
Lines 58-60, "member for preventing escape of micro particles according to claim 1, wherein pile yarns are brushed" should read -- member of claim 1, wherein said flock has been brushed --.

Signed and Sealed this

Twenty-fourth Day of August, 2004

JON W. DUDAS
*Director of the United States Patent and Trademark Office*